US009070375B2

(12) United States Patent
Fukuda et al.

(10) Patent No.: US 9,070,375 B2
(45) Date of Patent: Jun. 30, 2015

(54) VOICE ACTIVITY DETECTION SYSTEM, METHOD, AND PROGRAM PRODUCT

(75) Inventors: Takashi Fukuda, Yokohama (JP); Osamu Ichikawa, Yokohama (JP); Masafumi Nishimura, Yokohama (JP)

(73) Assignee: International BUsiness Machines Corporation, Armonk, NY (US)

( * ) Notice: Subject to any disclaimer, the term of this patent is extended or adjusted under 35 U.S.C. 154(b) by 1555 days.

(21) Appl. No.: 12/394,631

(22) Filed: Feb. 27, 2009

(65) Prior Publication Data

US 2009/0222258 A1 Sep. 3, 2009

(30) Foreign Application Priority Data

Feb. 29, 2008 (JP) ..... 2008-050537

(51) Int. Cl.
*G10L 19/02* (2013.01)
*G10L 25/93* (2013.01)

(52) U.S. Cl.
CPC ..... *G10L 25/93* (2013.01)

(58) Field of Classification Search
USPC ..... 704/214, 208
See application file for complete search history.

(56) References Cited

FOREIGN PATENT DOCUMENTS

JP 2009-058708 3/2009

OTHER PUBLICATIONS

Ishizuka et al.,"Study of Noise Robust Voice Activity Detection Based on Period Component to Aperiodic Component Ratio", 2006, ISCA, pp. 65-70.*
Wu et al., "Voice Activity Detection Based on Auto-Correlation Function Using Wavelet Transform and Teager Energy Operator", 2006, pp. 87-100.*
Gazor, "A Soft Voice Activity Detector Based on a Laplacian-Gaussian Model", 2003, IEEE, pp. 498-505.*
Tomi Kinnunen et al., "Temporal Discrete Cosine Transform: Towards Longer Term Temporal Features for Speaker Verification", 2006, pp. 1-12.*
Liang Gu et al., "Perceptual Harmonic Cepstral Coefficients for Speech Recognition in Noisy Environment", 2001, pp. 125-128.*
Tenkasi Ramabadran et al., "Enhancing Distributed Speech Recognition with Back-End Speech Reconstruction", 2001, Eurospeech, pp. 1-4.*
Tomi Kinnunen et al., "Voice Activity Detection Using MFCC Features and Support Vector Machine", 2007, Int. Conf. on Speech, pp. 1-4.*
Mel-frequency cepstrum, http://en.wikipedia.org/wiki/Mel-frequency_cepstrum.*
Shikano, et al., "IT Text Automatic speech recognition System," edited by IPSJ, Ohmsha, Chapter 1, pp. 4-14, May 2001.
Sohn, et al., "A statistical model based voice activity detection," IEEE Signal Processing Letters, vol. 6, No. 1, pp. 1-3, Jan. 1999.
Binder, et al., "Speech non-speech separation with GMM," Proc. of ASJ Fall Meeting, pp. 141-142, Oct. 2001.

* cited by examiner

*Primary Examiner* — Douglas Godbold
*Assistant Examiner* — Mark Villena
(74) *Attorney, Agent, or Firm* — Jennifer R. Davis; Anne Vachon Dougherty

(57) ABSTRACT

A voice activity detection method in a low SNR environment. The voice activity detection is performed by extracting a long-term spectrum variation component and a harmonic structure as feature vectors from a speech signal and increasing difference in feature vectors between speech and non-speech (i) using the long-term spectrum variation component feature or (ii) using a long-term spectrum variation component extraction and a harmonic structure feature extraction. A correct rate and an accuracy rate of the voice activity detection is improved over conventional methods by using a long-term spectrum variation component having a window length over an average phoneme duration of an utterance in the speech signal. The voice activity detection system and method provides speech processing, automatic speech recognition, and speech output capable of very accurate voice activity detection.

8 Claims, 6 Drawing Sheets

VOICE ACTIVITY DETECTION SYSTEM, METHOD, AND PROGRAM PRODUCT

CROSS-REFERENCE TO RELATED APPLICATIONS

This application claims priority under 35 U.S.C. §119 to Japanese Patent Application No. 2008-50537 filed Feb. 29, 2008, the entire contents of which are incorporated by reference herein.

BACKGROUND OF THE INVENTION

1. Field of the Invention

The present invention relates to automatic speech recognition and more particularly to a technique for accurately detecting voiced segment of a target speaker.

2. Description of the Related Art

In recent years, there is an increasing demand for automatic speech recognition technology, particularly in automobiles. More specifically, there has been a need for manual operations also with respect to operations not directly related to driving, such as button operations of a navigation system or of an air conditioner in automobiles. As a result, there is an increased risk of accidents due to careless steering operations by drivers while performing the above manual operations. Consequently, more vehicles are now equipped with systems that enable a driver to perform various operations with voice instructions while concentrating on driving. While the driver is driving, a microphone by a map light unit picks up a driver's voice when the driver issues a voice instruction. The system then recognizes and converts the voice to a command so as to control the car navigation system, which thereby activates the car navigation system. In the same manner, it is possible for the driver to perform the operations of an air conditioner and an audio system with voice. As described above, it is possible to provide a technique for performing a handsfree operation not directly related to driving in a car.

There is a known technique of detecting and using voiced segment as preprocessing of automatic speech recognition in the technical field of the automatic speech recognition. The speech signal segment that is determined by a voice activity detection (VAD) unit is important to the performance of the automatic speech recognition in general automatic speech recognition and the VAD performance has a decisive influence on the performance of the automatic speech recognition. In many cases, the VAD unit includes a feature extractor and a subsequent discrimination unit and currently being studied is the technique for extracting features from a speech signal with the aim of accurately detecting voiced segment.

Shikano, et al., "IT Text Automatic speech recognition System," May 2001, discloses an approach for speech feature extraction which is typically used in the automatic speech recognition and voice activity detection. However, the discrimination unit has traditionally been studied. Sohn, et al., "A statistical model based voice activity detection," January 1999, discloses a technique of using a statistical model based on a Gaussian distribution for VAD in order to improve the accuracy in the VAD by reducing the influence of background noise as a typical discrimination unit. Binder, et al., "Speech non-speech separation with GMM," October 2001, discloses that a mel frequency cepstrum coefficient (MFCC) or the like is used for a feature vector for VAD using the statistical model. In addition, the inventors in this invention applied a speech processing method and system capable of stable automatic speech recognition under noisy environments by extracting a harmonic structure of a human speech from an observed speech and directly designing a filter having weights in the harmonic structure from the observed speech to emphasize the harmonic structure in the speech spectrum (Refer to Japanese Patent Application No. 2007-225195).

Because automatic speech recognition in cars is adversely affected by various background noises such as a driving noise, air-conditioner noise, and a window open condition. It has been difficult to achieve a high performance not only in the automatic speech recognition itself, but also in voice activity detection. In the related art and the combination of the related art, a difference in the feature vector between speech and non-speech is ambiguous when background noise in cars increases, making it difficult to detect voiced segment accurately in the situation of a low signal-to-noise (S/N) ratio.

SUMMARY OF THE INVENTION

In one aspect, the present invention provides a speech processing system for processing a speech by a computer that includes: a means for dividing said speech signal into frames; a means for converting said speech signal divided into frames to a logarithmic power spectrum; a means for transforming said logarithmic power spectrum to mel cepstrum coefficients; a means for extracting a long-term spectrum variation component from a sequence of said mel cepstrum coefficients by using a longer delta window than an average phoneme duration of an utterance in said speech signal; and a means for determining voiced segment by using said long-term spectrum variation component.

In another aspect, the present invention provides a speech processing method for processing a speech signal by a computer that includes the steps of: dividing said speech signal into frames; converting said speech signal divided into frames to a logarithmic power spectrum; transforming said logarithmic power spectrum to mel cepstrum coefficients; extracting a long-term spectrum variation component from a sequence of said mel cepstrum coefficients by using a longer delta window than an average phoneme duration of an utterance in said speech signal; and determining voiced segment by using said long-term spectrum variation component.

The present invention further provides a speech processing program product tangibly embodying instructions which when implemented causes the computer to perform the steps of the above process.

Still further, the present invention provides a speech output system for outputting a speech entered from a microphone by a computer that includes: a means for converting said speech entered from said microphone into a digital speech signal by A/D conversion; a means for dividing said digital speech signal into frames; a means for converting said digital speech signal divided into frames to a logarithmic power spectrum; a means for transforming said logarithmic power spectrum to mel cepstrum coefficients; a means for extracting a long-term spectrum variation component from a sequence of said mel cepstrum coefficients by using a longer delta window than an average phoneme duration of an utterance in said digital speech signal; a means for determining voiced segment by using said long-term spectrum variation component; a means for discriminating speech and non-speech segments in said digital speech signal by using said voiced segment information; and a means for converting said discriminated speech included in said digital speech signal into said speech as an analog speech signal by D/A conversion.

The present invention improves the VAD performance by increasing the difference in a feature vector between speech and non-speech by improving the feature vector for VAD using a spectrum variation component of a long time segment.

More specifically, the present invention detects voiced segment accurately in environments with background noises or in a low S/N environment where the speech intensity of a target speaker is low relative to the background noise. Therefore, the present invention has an advantageous effect of providing an automatic speech recognition system that allows very accurate voice activity detection.

DETAILED DESCRIPTION OF THE PREFERRED EMBODIMENTS

Figure 1:
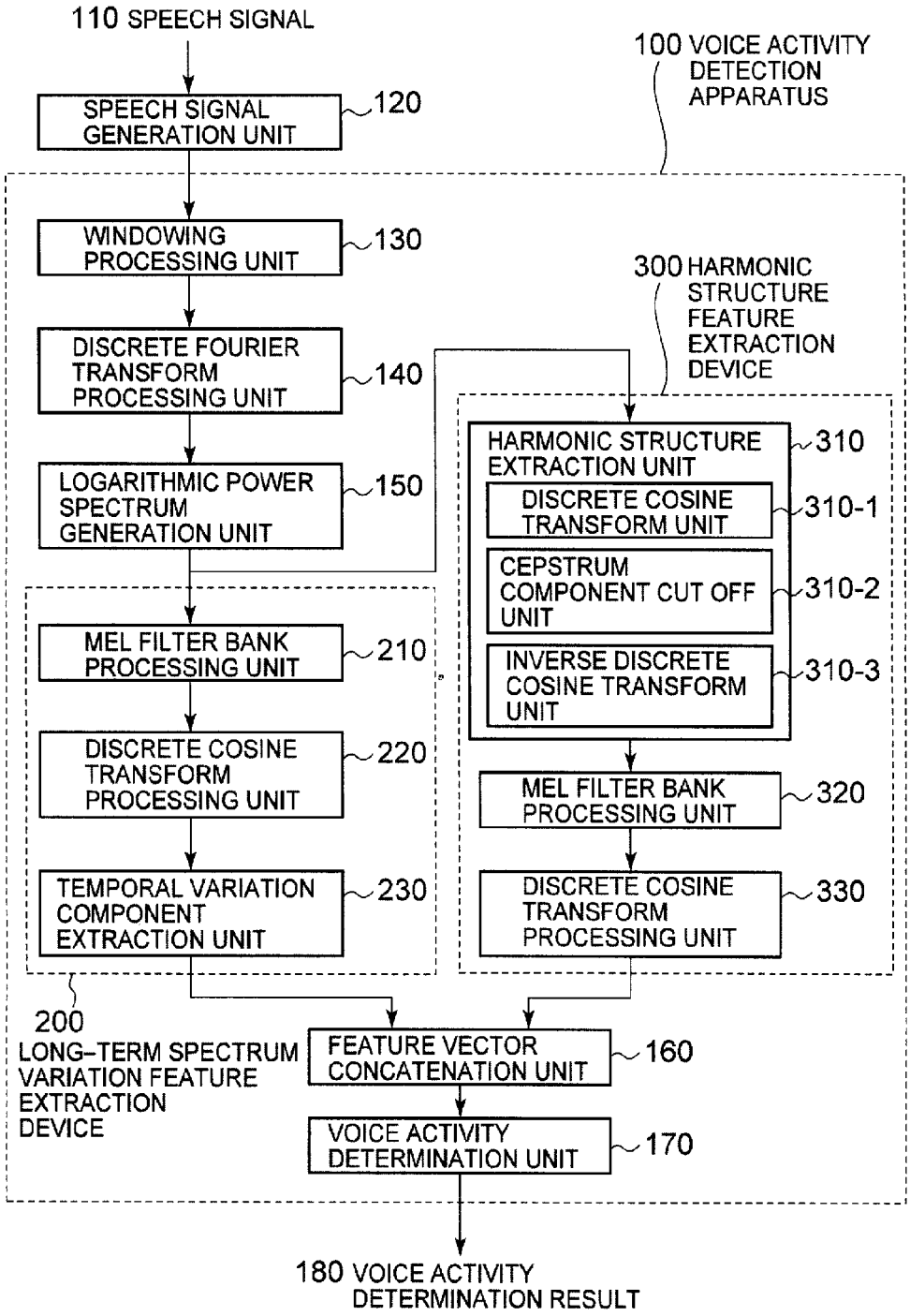
FIG. 1 is a diagram illustrating means for performing voice activity detection according to one embodiment of the present invention.

The preferred embodiments of the present invention will now be described hereinafter with reference to the accompanying drawings. It is understood that these embodiments are illustrative only, and the technical scope of the present invention is not limited to the embodiments.

The present invention increases the accuracy of voice activity detection based on a statistical model using a Gaussian mixture model (hereinafter, referred to simply as GMM) by improving a feature extraction process.

The present invention also increases the performance of voice activity detection by incorporating a technique of extracting long-term spectrum variation components of a speech spectrum and designing a filter having weights in the harmonic structure from an observed speech into a feature extraction process. Particularly, the present invention can achieve very accurate voice activity detection in a low S/N environment.

The present invention focuses on long-term spectrum variation, which has not been used in a conventional method based on the statistical model, i.e., spectrum variation along the time axis that is calculated over an average phoneme duration, in the voice activity detection and then finding a technique for reducing the influence of the background noise using the spectrum variation in addition to extracting a harmonic structure from observed speech as features for VAD.

In order to solve the above problem, the present invention includes the means described below.

According to the present invention, the voice activity detection for automatic speech recognition employs a long-term spectrum variation component extraction or a long-term spectrum variation component extraction and a harmonic structure feature extraction. The feature vector obtained by the long-term spectrum variation component extraction is used for voiced segment determination based on a Gaussian mixture model, namely a determination means for determining speech or non-speech. More specifically, the determination means determines speech or non-speech by using a likelihood approach.

In the long-term spectrum variation component extraction, the long-term spectrum variation component is extracted as a feature vector from the observed speech. More specifically, the long-term spectrum variation component is obtained as a feature vector by performing frame division processing with a window function, a logarithmic power spectrum conversion, mel filter bank processing, mel cepstrum transform, and long-term variation component extraction for the observed speech. The long-term spectrum variation component is a feature vector output for each frame.

In the harmonic structure feature extraction, a harmonic structure is extracted as a feature vector from the observed speech. More specifically, the observed speech is subjected to a logarithmic power spectrum conversion, cepstrum conversion through discrete cosine transform, a cutting of upper and lower cepstrum components, an inverse discrete cosine transform, a transform back to the power spectrum domain, a mel filter bank processing, and a harmonic structure feature extraction through the discrete cosine transform. The harmonic structure feature is a second set of cepstrum coefficients (fLPE cepstrum: feature Local Peak Enhancement cepstrum) based on the observed speech and a feature vector output for each frame. The cutting of the upper and lower cepstrum components is performed in order to extract a harmonic structure in a possible range as a human speech. In addition, it is possible to appropriately normalize the input of the mel filter bank processing that has been transformed to the power spectrum domain.

Both of the long-term spectrum variation component extraction and the harmonic structure feature extraction include a common step of performing the logarithmic power spectrum conversion for the observed speech. Therefore, it is possible to consider the step up to the logarithmic power spectrum conversion as common processing.

In the voice activity detection for automatic speech recognition according to the present invention, the voiced segment is determined by using a feature vector, which is obtained by the long-term spectrum variation component extraction. Moreover, in the voice activity detection for automatic speech recognition according to the present invention, it is possible to use feature vectors obtained by the long-term spectrum variation component extraction and the harmonic structure feature extraction at a time. More specifically, it is possible to use a feature vector for the voice activity detection for automatic speech recognition. The feature vector is obtained by concatenating the feature vectors and is the output for each frame. The feature vector also includes a feature vector obtained by the long-term spectrum variation component extraction.

The present invention also includes the combination of the techniques described herein with an existing noise removal technique such as spectral subtraction. Similarly, a speech processing system, an automatic speech recognition system, and a speech output system, each including the techniques described herein, are also included in the present invention. Moreover, the present invention also includes the steps for the voice activity detection in a program form, namely as a program product that can be stored in a field programmable gate array (FPGA), an application specific integrated circuit (ASIC), a hardware logic element equivalent thereto, a programmable integrated circuit, or a combination thereof. More specifically, the present invention includes a voice activity detection apparatus in the form of a custom large-scale integrated circuit (LSI) having speech input/output, a data bus, a memory bus, a system bus and the like, and the program product stored in the integrated circuit as such.

Referring to FIG. 1, a diagram is shown illustrating the means for performing voice activity detection according to one embodiment of the present invention. A voice activity detection apparatus 100 includes a windowing processing unit 130, a discrete Fourier transform processing unit 140, a logarithmic power spectrum generation unit 150, a feature vector concatenation unit 160, and a voice activity determination unit 170. Moreover, the voice activity detection apparatus 100 includes a long-term spectrum variation feature extraction device 200 and a harmonic structure feature extraction device 300. The long-term spectrum variation feature extraction device 200 includes a mel filter bank processing unit 210, a discrete cosine transform processing unit 220, and a temporal variation component extraction unit 230. The harmonic structure feature extraction device 300 includes a harmonic structure extraction unit 310, a mel filter bank processing unit 320, and a discrete cosine transform processing unit 330. Moreover, the harmonic structure extraction unit 310 includes a discrete cosine transform unit (310-1), a cepstrum component cut off unit (310-2), and an inverse discrete cosine transform unit (310-3).

In one embodiment, the speech signal generation unit 120 can be arbitrarily connected to the windowing processing unit 130 in the voice activity detection apparatus 100. The speech signal generation unit 120 receives speech signal 110 as an input and generates and outputs a signal in computer-processable form. More specifically, the speech signal generation unit 120 converts a speech signal, which is obtained via a microphone and an amplifier (not shown), from an utterance to computer-processable coded data using an A/D converter. The speech signal generation unit 120 can be an interface for use in speech input that can be incorporated in a personal computer or the like. In another embodiment, digital speech data prepared in advance can be used as an input to the windowing processing unit 130, without intervention by the speech signal generation unit 120.

In the windowing processing unit 130, a voice activity detection apparatus 100 according to one embodiment of the present invention appropriately performs window function processing of the Hamming window, Hanning window, or the like for the speech signal which is the computer-processable coded data to divide the speech signal into frames. In one embodiment, a frame length is typically 25 ms and preferably ranges from 15 ms to 30 ms. In addition, the frame shift length is typically 10 ms and preferably ranges from 5 ms to 20 ms. It is understood that the frame length and the frame shift length are not limited thereto, but can be set to appropriate values on the basis of observed speech.

Subsequently, the voice activity detection apparatus 100 transforms the speech signal to a spectrum in the discrete Fourier transform processing unit 140 and further transforms the spectrum to a power spectrum in logarithmic scale in the logarithmic power spectrum generation unit 150. The logarithmic power spectrum is an input to the long-term spectrum variation feature extraction device 200 and the harmonic structure feature extraction device 300. The logarithmic power spectrum is expressed by the following equation:

$$X_T(j)=\log(x_t(j)) \qquad \text{Eq. 1}$$

where $x_t(j)$ is the power spectrum of the speech signal and is an absolute value of an output of the discrete Fourier transform processing unit 140, which is well-known in the technical field. In addition, t and T are frame numbers, and j is a bin number of discrete Fourier transform. The bin number corresponds to a frequency of the discrete Fourier transform. For example, if the discrete Fourier transform of 512 points is applied at a sampling frequency 16 KHz, the following is obtained:

| Bin number | 0 | 1 | 2 | 3 | ... | 256 |
|---|---|---|---|---|---|---|
| Frequency | 0 Hz | 31.25 Hz | 62.5 Hz | 93.75 Hz | ... | 8000 Hz |

More specifically, the outputs of the discrete Fourier transform are collected into frequencies in step-like formations and referenced with the numbers.

The long-term spectrum variation feature extraction device 200 performs mel filter bank processing for the logarithmic power spectrum in the mel filter bank processing unit 210 to obtain a vector $Y_T(k)$. In the above, k is a channel number. Subsequently, the long-term spectrum variation feature extraction device 200 obtains a mel cepstrum $C_T(i)$ from the vector $Y_T(k)$ in the discrete cosine transform processing unit 220 as expressed by the following equation:

$$C_T(i) = \sum_k M(i,k)\cdot Y_T(k) Y_T(k) \qquad \text{Eq. 2}$$

$$k$$

where M(i, k) is a discrete cosine transform matrix and i is a dimension number of the mel cepstrum. The mel cepstrum $C_T(i)$ is also referred to as MFCC (mel-frequency cepstrum coefficient).

The long-term spectrum variation feature extraction device 200 further performs a linear regression calculation as expressed by the following equation, with respect to each dimension of the mel cepstrum $C_T(i)$, to calculate a temporal variation component of cepstrum in the temporal variation component extraction unit 230:

$$D_T(i) = \frac{\sum_{\theta=1}^{\Theta} \{\theta\cdot(C_{T+\theta}(i) - C_{T-\theta}(i))\}}{2\sum_{\theta=1}^{\Theta}\theta^2} \qquad \text{Eq. 3}$$

where DT(i) is a temporal variation component of the mel cepstrum (delta cepstrum) and Θ is a window length. In the automatic speech recognition of the technical field, Θ is a time length for obtaining spectrum variation. Typically, the delta cepstrum is obtained in a short-term segment of Θ that equals 2 to 3 (40 ms to 60 ms in terms of time): from a viewpoint of modeling individual phonemes, a value nearly equal to or slightly less than the phoneme duration is used for the delta cepstrum. Conventionally, Θ of 2 to 3 has generally been used in VAD on the basis of knowledge in the field of automatic speech recognition. The present inventors, however, have found that the important information for VAD can exist in a longer-term segment.

In the voice activity detection according to the present invention, the long-term spectrum variation component (long-term delta cepstrum) where Θ is 4 or greater (80 ms or more in terms of time) is used for VAD. For convenience, the delta cepstrum used for automatic speech recognition according to a related art is referred to as short-term spectrum variation component (short-term delta cepstrum) in order to make a distinction between the related art and the present invention. In the VAD based on the statistical model, conventionally there has not been an example of the utility of the long-term spectrum variation component. The embodiment described later, however, shows that the long-term spectrum variation exerts a very large effect. Although the linear regression calculation is used here to calculate the long-term spectrum variation, the linear regression calculation can be replaced by a simple difference operation, a discrete Fourier transform along the time axis, or a discrete wavelet transform.

The long-term spectrum variation component can be calculated from the linear regression calculation with a longer window length than an average phoneme duration included in the observed speech. The average phoneme duration depends on an individual observed speech and can be both short and long. For example, the average phoneme duration of an observed speech spoken rapidly can be shorter than the average phoneme duration of an observed speech spoken slowly. In a voice activity detection method according to one embodiment of the present invention, it is only necessary to use a long-term spectrum variation component obtained from a long window length for VAD, and the observed speech can be spoken both rapidly and slowly. The window length Θ can be set for each observed speech or it can be selected out of typical values prepared in advance, and it is possible to design the setting of the window length Θ appropriately. While Θ is 4 or greater in one embodiment, the value is not limited thereto. Moreover, while the long-term spectrum variation component has been obtained from the MFCC (mel cepstrum) in one embodiment, alternatively the long-term spectrum variation component can be obtained from other features used in this technical field such as a linear predictive coefficient (LPC) mel cepstrum or a relative spectral (RASTA: a filter technology for extracting an amplitude fluctuation property of a speech) based features.

The harmonic structure feature extraction device 300 directly extracts a harmonic structure feature from the observed speech in the harmonic structure extraction unit 310. More specifically, the harmonic structure feature extraction device 300 performs the following processing steps:

1. Receiving a logarithmic power spectrum divided into frames as an input;
2. Transforming the logarithmic power spectrum to a cepstrum by a discrete cosine transform (DCT);
3. Cutting off (setting to zero) the upper and the lower cepstrum components in order to remove wider changes and narrower changes in a spectrum domain than the interval of the harmonic structure of a human speech;
4. Obtaining a power spectrum representation by the inverse discrete cosine transform (IDCT or Inverse DCT) and index transform;
5. Normalizing the obtained power spectrum in such a way that the average is set to 1 (It is possible to omit the normalization step);
6. Performing mel filter bank processing for the power spectrum; and
7. Transforming an output of the mel filter bank processing to a harmonic structure feature by DCT to obtain a VAD feature vector.

First, the logarithmic power spectrum divided into frames is entered into the harmonic structure feature extraction device 300. The harmonic structure feature extraction device 300 transforms the entered logarithmic power spectrum to the cepstrum in the discrete cosine transform unit (310-1) of the harmonic structure extraction unit 310, as expressed by the following equation:

$$C_T(i) = \sum_j D(i, j) \cdot X_T(j) \qquad \text{Eq. 4}$$

where D(i, j) is a discrete cosine transform matrix and is typically expressed by the following equation:

$$D(i, j) = \sqrt{\frac{2}{n}} K_i \cos\left(\frac{(i-1)\left(j-\frac{1}{2}\right)}{n}\pi\right) \qquad \text{Eq. 5}$$

$$\begin{cases} K_i = \frac{1}{\sqrt{2}}, & i = 0 \\ K_i = 1, & i \neq 0 \end{cases}$$

Moreover, the harmonic structure feature extraction device 300 uses cepstrum components corresponding to the harmonic structure of a human speech and cuts off other cepstrum components in the cut of cepstrum component unit (310-2) of the harmonic structure extraction unit 310. More specifically, the processing expressed by the following equations is performed:

$$\begin{cases} \hat{C}_T(i) = \varepsilon C_T(i) & , i < \text{lower_cep_num} \\ \hat{C}_T(i) = \varepsilon C_T(i) & , i > \text{upper_cep_num} \\ \hat{C}_T(i) = C_T(i) & , i \text{ in other range} \end{cases} \qquad \text{Eq. 6}$$

where the left-hand side of each equation is a cepstrum after the execution of the cut processing, ϵ is 0 or an extremely small constant, and lower_cep_num and upper_cep_num are cepstrums corresponding to possible ranges as the harmonic structure of the human speech. In one embodiment, supposing that the fundamental frequency of the human speech ranges from 100 Hz to 400 Hz, lower_cep_num can be set to 40 and upper_cep_num set to 160. It should be noted here that these settings are examples where a sampling frequency is 16 KHz with the FFT width of 512 points.

Subsequently, the harmonic structure feature extraction device 300 obtains the logarithmic power spectrum representation by the inverse discrete cosine transform in the inverse discrete cosine transform unit (310-3) of the harmonic structure extraction unit 310, as expressed by the following equation:

$$W_T(j) = \sum_i D^{-1}(j, i)\hat{C}_T(i) \qquad \text{Eq. 7}$$

where $D^{-1}(j, i)$ is the (i, j) components of an inverse discrete cosine transform matrix $D^{-1}$. $D^{-1}$ is an inverse matrix of the discrete cosine transform matrix D and generally D is a unitary matrix, whereby $D^{-1}$ is obtained as a transposed matrix of D.

Subsequently, the harmonic structure feature extraction device 300 transforms $W_T(j)$ in the logarithmic power spectrum domain back to those in the power spectrum domain by the index transform as expressed by the following equation:

$$w_T(j) = \exp(W_T(j)) \qquad \text{Eq. 8}$$

Furthermore, the harmonic structure feature extraction device 300 normalizes wT(j) in such a way that the average value is set to 1 as expressed by the equation below. If a difference between the average value and 1 is considered to be small, the normalization processing can be omitted.

$$w_T(j) = w_T(j)\frac{\text{Num_bin}}{\sum_k w_T(k)} \quad \text{Eq. 9}$$

where Num_bin is a bin total number. While $w_T(j)$ normalized as expressed by the above equation is a signal obtained by transforming the observed speech, $w_T(j)$ can be used as a filter having weights in the harmonic structure of the observed speech. In other words, this filter is capable of enhancing the harmonic structure included in the observed speech. The filter has a typical characteristic that the peak is generally low and smooth in the case where the observed speech is a non-speech or noise having no harmonic structure while the peak is high and sharp in the case where the observed speech is a human voice. In addition, this filter has an advantage that its operation is stable because there is no need to estimate a fundamental frequency explicitly. The harmonic structure feature extraction device does not use the filter to enhance the harmonic structure, but uses the filter as a feature vector for VAD after transforming them by subsequent processing.

Subsequently, the harmonic structure feature extraction device 300 performs mel filter bank processing for the appropriately normalized power spectrum $w_T(j)$ in the mel filter bank processing unit 320. Moreover, the harmonic structure feature extraction device 300 transforms the output of the mel filter bank processing by the discrete cosine transform to obtain the harmonic structure feature in the discrete cosine transform processing unit 330. The harmonic structure feature is a feature vector including the harmonic structure of the observed speech.

The voice activity detection method according to the embodiment of the present invention is capable of detecting speech/non-speech segments of the observed speech, with the long-term spectrum variation component (long-term delta cepstrum) and the harmonic structure as feature vectors. In the voice activity detection method according to the embodiment of the present invention, the feature vectors for detecting the speech/non-speech segments can be automatically obtained by processing the observed speech in a given procedure.

A voice activity detection apparatus 100 according to one embodiment of the present invention concatenates the long-term spectrum variation component with the harmonic structure feature in the feature vector concatenation unit 160. In one embodiment, the long-term spectrum variation component is a 12-dimensional feature vector and the harmonic structure feature is a 12-dimensional feature vector. The voice activity detection apparatus 100 is able to generate a 24-dimensional feature vector related to the speech signal 110 by concatenating these feature vectors. Alternatively, the feature vector concatenation unit 160 can generate a 26-dimensional feature vector related to the speech signal 110 by concatenating the 24-dimensional feature vector with a power of observed speech, which is a scalar value, and a variation component of the power of observed speech, which is a scalar value.

Subsequently, the voice activity detection apparatus 100 according to one embodiment of the present invention performs voice activity detection based on a statistical model to detect the speech/non-speech segments included in the speech signal 110 by using the feature vectors in the voice activity determination unit 170. While the statistical model in the voiced segment determination unit 170 is typically a Gaussian distribution, the statistical model can be any other probability distribution that can be used in this technical field such as the t distribution or Laplace distribution. Moreover, the voice activity detection apparatus 100 according to one embodiment of the present invention outputs a voiced segment determination result 180. Therefore, information for discriminating voiced segment for automatic speech recognition is obtained based on the speech signal 110 entered via the speech signal generation unit 120 or digital speech data entered into the windowing processing unit 130.

In one embodiment, the voice activity detection apparatus 100 can be a computer having speech input means such as a sound board, a digital signal processor (DSP) having a buffer memory and a program memory, or a one-chip custom large-scale integrated circuit (LSI).

The voice activity detection apparatus 100 according to one embodiment of the present invention is capable of generating information for voice activity detection by extracting the long-term spectrum variation feature and the harmonic structure feature on the basis of the speech signal 110 or digital speech data entered into the windowing processing unit 130. Therefore, the voice activity detection apparatus 100 according to one embodiment of the present invention has an advantageous effect of automatically generating information for voice activity detection from the entered speech data.

Figure 2:
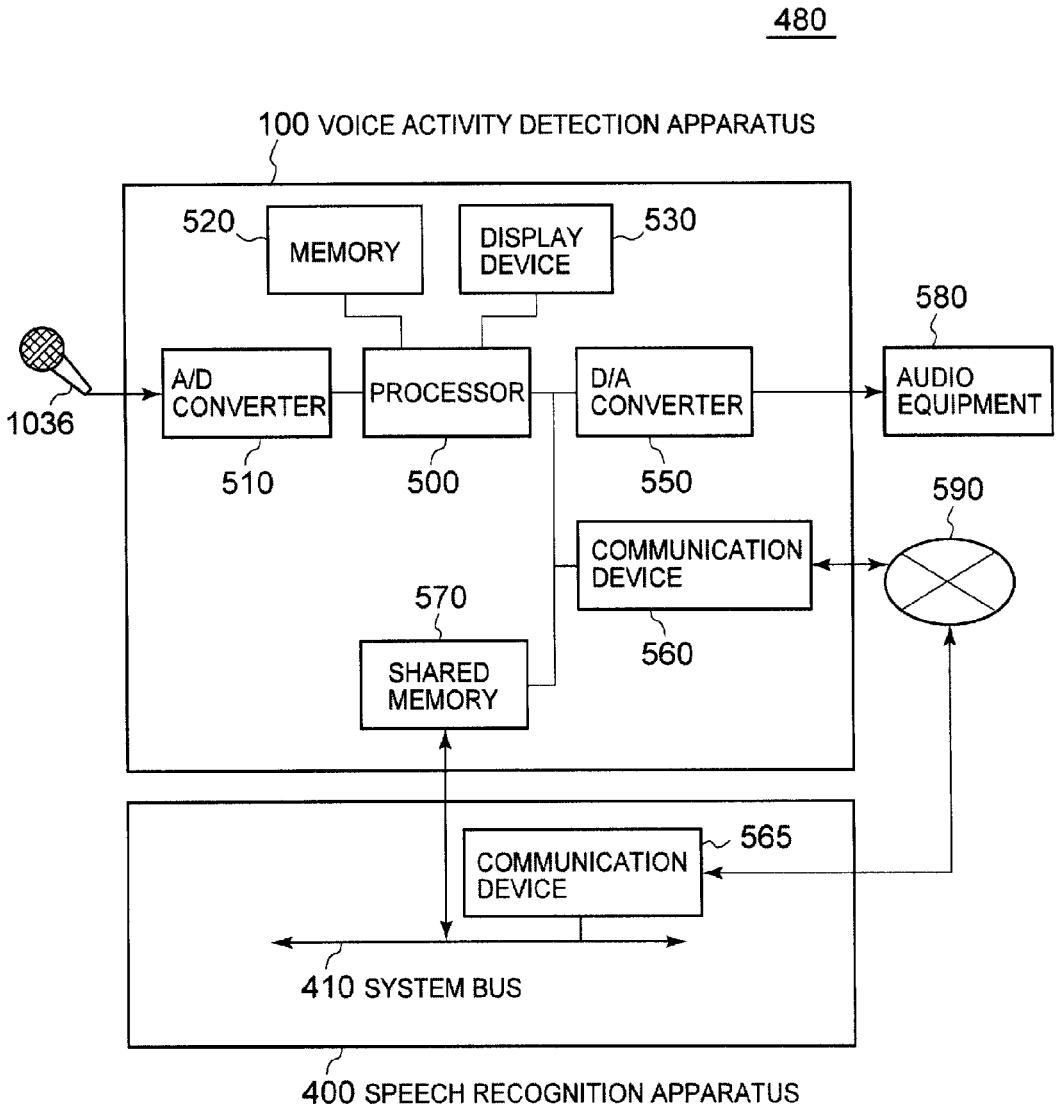
FIG. 2 is a diagram illustrating the configuration of an automatic speech recognition system including a voice activity detection apparatus according to one embodiment of the present invention.

Referring to FIG. 2, a diagram is shown illustrating the configuration of an automatic speech recognition system including a voice activity detection apparatus according to one embodiment of the present invention. The automatic speech recognition system 480 shown in FIG. 2 includes the voice activity detection apparatus 100 and an automatic speech recognition apparatus 400 and includes a microphone 1036, audio equipment 580, a network 590, and the like. The voice activity detection apparatus 100 includes a processor 500, an A/D converter 510, a memory 520, a display device 530, a D/A converter 550, a communication device 560, a shared memory 570, and the like.

In FIG. 2, a speech generated in the vicinity of the microphone 1036 is entered into the A/D converter 510 as an analog signal by the microphone 1036 and converted to a digital signal processable by the processor 500. The processor 500 performs various steps for extracting the long-term spectrum variation component and the harmonic structure from the speech by using the memory 520 or the like as a working area appropriately using software (not shown) prepared in advance. The processor can display processing statuses on the display device 530 via an I/O interface (not shown). Although FIG. 2 shows that the microphone 1036 is disposed in the outside of the voice activity detection apparatus 100, the microphone 1036 and the voice activity detection apparatus 100 can be formed integrally into a one-piece apparatus.

The digital speech signal processed by the processor 500 can be converted to an analog signal by the D/A converter 550 which can be inputted into the audio equipment 580 or the like. Accordingly, the speech signal after the voice activity detection is outputted from the audio equipment 580 or the like. In addition, the digital speech signal processed by the processor 500 can be sent to the network 590. This allows the output of the voice activity detection apparatus 100 according to the present invention to be used in other computer resources. For example, the automatic speech recognition apparatus 400 can connect to the network 590 via a communication device 565 to use the digital speech signal processed by the processor 500. Moreover, the digital speech signal processed by the processor 500 can be outputted in such a way as to be accessible from other computer systems via the shared memory 570. More specifically, it is possible to use a dual port memory device that can be connected to a system bus 410 included in the automatic speech recognition apparatus 400 as the shared memory 570.

In the automatic speech recognition system 480 according to one embodiment of the present invention, a part or all of the voice activity detection apparatus 100 can be formed by using a field programmable gate array (FPGA), an application specific integrated circuits (ASIC), and hardware logic elements equivalent thereto or programmable integrated circuits. For example, it is also possible to provide a part or all of the voice activity detection apparatus 100 as a one-chip custom LSI having speech input/output, a data bus, a memory bus, a system bus, a communication interface and the like, with the functions of the A/D converter 510, the processor 500, the D/A converter 550, and the communication device 560 and various steps for voice activity detection configured by hardware logic and incorporated.

In one embodiment, the voice activity detection apparatus 100 according to the present invention can include the processor 500 for voice activity detection. In another embodiment, the voice activity detection apparatus 100 according to the present invention can be incorporated into the inside of the automatic speech recognition apparatus 400 so as to perform various steps for voice activity detection by using a processor (not shown) included in the automatic speech recognition apparatus 400.

It is possible to use the speech after voice activity detection as an analog speech signal or digital signal from the audio equipment, the network resources, or the automatic speech recognition system by using the automatic speech recognition system 480 according to the present invention.

Figure 3:
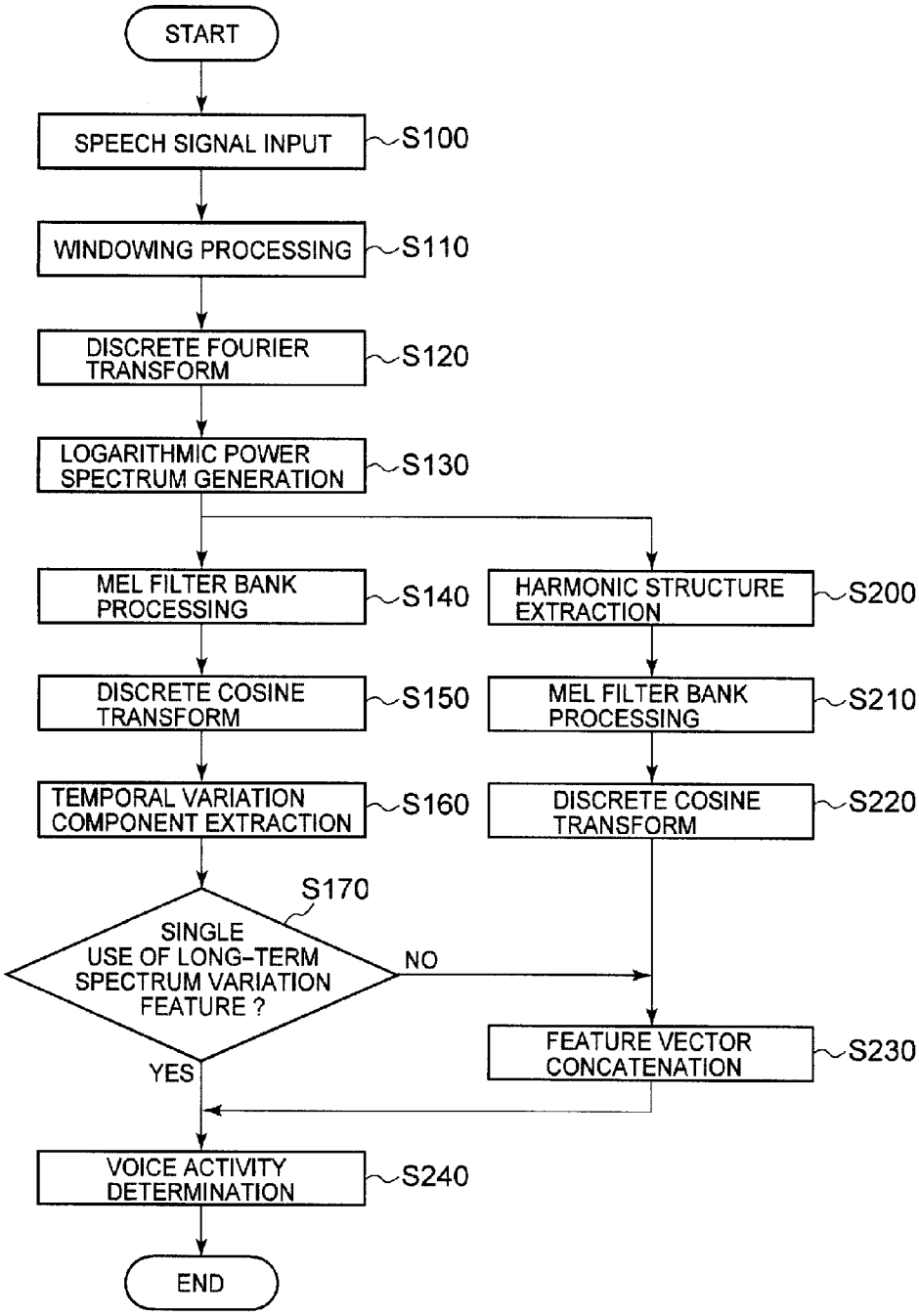
FIG. 3 is a flowchart of a voice activity detection method according to one embodiment of the present invention.

Referring to FIG. 3, a flowchart is shown illustrating a voice activity detection method according to one embodiment of the present invention. The same parts as those described with reference to FIG. 1 such as individual computation processes will be omitted here.

According to the voice activity detection method of one embodiment of the present invention, a human speech entered from the microphone, namely an observed speech, is converted to computer-processable numerical data as an input for various steps for voice activity detection in a speech signal input step (S100). More specifically, the observed speech is sampled by using the A/D converter included in the speech signal processing board. In this step, the bit width, the frequency band, and the like of the observed speech are appropriately set.

Next in a windowing processing step (S110), window function processing of the Hamming window or Hanning window is appropriately performed in response to the foregoing input and the speech signal is divided into frames.

Next in a discrete Fourier transform processing step (S120), the speech signal is transformed to a spectrum. In a logarithmic power spectrum conversion step (S130), the spectrum is converted to a logarithmic power spectrum. The logarithmic power spectrum is an input common to both of the subsequent step S140 and step S200.

Step S140 to step S160 are steps for extracting a long-term spectrum variation feature. According to the voice activity detection method of one embodiment of the present invention, mel filter bank processing is performed for the logarithmic power spectrum to convert the logarithmic power spectrum to information reflecting a human hearing characteristic in a mel filter bank processing step (S140).

Next in a discrete cosine transform processing step (S150), an output of the mel filter bank processing is transformed by the discrete cosine transform to obtain a mel cepstrum.

Subsequently, according to the voice activity detection method of one embodiment of the present invention, a temporal variation component of the mel cepstrum (delta cepstrum) is obtained in a temporal variation component extraction step (S160). More specifically, the long-term spectrum variation component is extracted by using a window length over the average phoneme duration. This long-term spectrum variation component is a feature vector output for each frame. While the (long-term) delta cepstrum is typically calculated by using the window length of 80 ms or more as time, it is understood that the delta cepstrum is not limited thereto.

Subsequently, according to the voice activity detection method of one embodiment of the present invention, it is determined whether the feature for use in voice activity detection is only the delta cepstrum in a step of determining a single use of the long-term spectrum variation feature (S170). The condition for the determination in step S170 can be previously entered by a user, a user's input of the condition can be accepted while the voice activity detection processing is performed, or the determination can be automatically performed in response to a situation of the observed speech such as, for example, where the amplitude of the logarithmic power spectrum obtained in step S130 is greater than a given numerical value, and thus the condition can be appropriately designed. If the feature for use in voice activity detection is only a (long-term) delta cepstrum, the control proceeds to step S240. Otherwise, the control proceeds to step S230.

Step S200 to step S220 are steps for extracting a harmonic structure feature. According to the voice activity detection method of one embodiment of the present invention, the spectrum amplitude is normalized appropriately by performing the cepstrum transform, a cut of the cepstrum components, and the logarithmic power spectrum conversion in a harmonic structure extraction step (S200). These steps allow a signal, which is usable as a filter having weights in the harmonic structure of the observed speech and includes the harmonic structure thereof, to be obtained from the observed speech. Subsequently, according to the voice activity detection method of one embodiment of the present invention, mel filter bank processing is performed for the signal including the harmonic structure of the observed speech to convert the signal to information reflecting the human hearing characteristic in a mel filter bank processing step (S210).

Next in a discrete cosine transform processing step (S220), an output of the mel filter bank processing is transformed by the discrete cosine transform to obtain the harmonic structure feature. The harmonic structure feature is a second cepstrum based on the observed speech and a feature vector including the harmonic structure.

According to the voice activity detection method of one embodiment of the present invention, a feature vector including a long-term spectrum variation component is concatenated with a feature vector including the harmonic structure in a feature vector concatenation step (S230). In one embodiment, the long-term spectrum variation component can be a 12-dimensional feature vector and the harmonic structure feature can be a 12-dimensional feature vector. The voice activity detection method of one embodiment of the present invention is capable of generating a 24-dimensional feature vector related to the observed speech by concatenating the foregoing feature vectors. Moreover, in the feature vector concatenation step (S230), a 26-dimensional feature vector related to the observed speech can be generated by concatenating the 24-dimensional feature vector with the power of observed speech, which is a scalar value, and a variation component of the power of observed speech, which is a scalar value.

According to the voice activity detection method of one embodiment of the present invention, the voiced segment included in the observed speech is determined based on the likelihood information output of the statistical model in the voice activity determination step (S240) by using the long-term spectrum variation component obtained in step S160 as a feature vector or using the long-term spectrum variation and the harmonic structure concatenated in step S230 as feature vectors.

In the voice activity detection method according to the present invention, both of the long-term spectrum variation feature and the harmonic structure feature are automatically obtained by processing of the foregoing various steps on the basis of the observed speech. Therefore, the present invention has an advantageous effect in that it is possible to automatically perform the voice activity detection, which is preprocessing for automatic speech recognition, on the basis of the observed speech.

Figure 4:
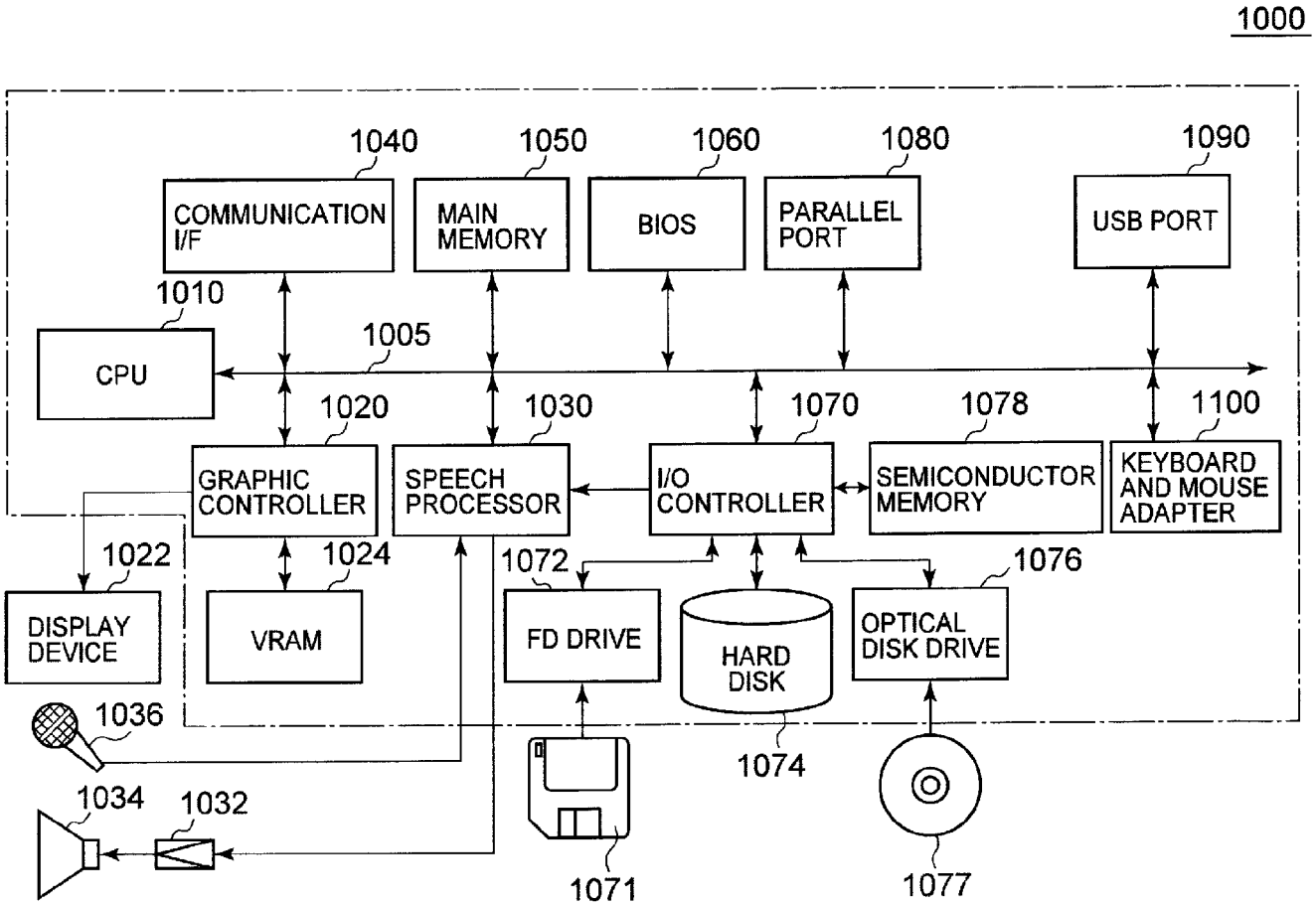
FIG. 4 is a diagram illustrating a hardware configuration of the voice activity detection apparatus according to one embodiment of the present invention.

Referring to FIG. 4, a diagram is shown illustrating the hardware configuration of a voice activity detection apparatus according to one embodiment of the present invention. In FIG. 4, assuming that the voice activity detection apparatus is an information processor 1000, the hardware configuration thereof is illustrated. Although the overall configuration of the information processor typified by a computer is described hereinafter, a required minimum configuration according to the environment can be selected.

The information processor 1000 includes a central processing unit (CPU) 1010, a bus line 1005, a communication interface 1040, a main memory 1050, a basic input output system (BIOS) 1060, a parallel port 1080, a USB port 1090, a graphic controller 1020, a VRAM 1024, a speech processor 1030, an I/O controller 1070, and input means such as a keyboard and a mouse adapter 1100. The I/O controller 1070 can be connected to a flexible disk (FD) drive 1072, a hard disk 1074, an optical disk drive 1076, a semiconductor memory 1078, and other memory means.

The speech processor 1030 is connected to a microphone 1036, an amplifier circuit 1032, and a loudspeaker 1034. Moreover, the graphic controller 1020 is connected to a display device 1022.

The BIOS 1060 stores a boot program executed by the CPU 1010 at startup of the information processor 1000, a program depending on the hardware of the information processor 1000, and the like. The FD drive 1072 reads a program or data from a flexible disk 1071 and provides the main memory 1050 or the hard disk 1074 with the program or data via the I/O controller 1070. While FIG. 4 shows an example where the hard disk 1074 is included in the information processor 1000, alternatively it is possible to connect or add a hard disk outside the information processor 1000 with an external device connection interface (not shown) connected to the bus line 1005 or the I/O controller 1070.

A DVD-ROM drive, a CD-ROM drive, a DVD-RAM drive, or a CD-RAM drive, for example, can be used as the optical disk drive 1076. In this use, it is necessary to use an optical disk 1077 corresponding to each drive. The optical disk drive 1076 is also capable of reading a program or data from the optical disk 1077 and providing the main memory 1050 or the hard disk 1074 with the program or data via the I/O controller 1070.

The computer program provided to the information processor 1000 is stored into the flexible disk 1071, the optical disk 1077, the memory card or other recording mediums and provided by a user. The computer program is read from the recording medium via the I/O controller 1070 or downloaded via the communication interface 1040, by which the computer program is installed into and executed by the information processor 1000. Because the operation that the computer program causes the information processor to perform is the same as that of the apparatus described above, the description thereof will be omitted here.

The foregoing computer program can be stored in an external storage medium. A usable storage medium is a magneto-optical recording medium such as a MD or a tape medium, in addition to the flexible disk 1071, the optical disk 1077, or a memory card. Alternatively, it is possible to use, as a recording medium, a storage device such as a hard disk or an optical disk library provided in a server system connected to a leased line or the Internet in order to provide the computer program to the information processor 1000 via the communication line.

Although the information processor 1000 has been mainly described in the above embodiments, the same functions as those of the information processor described above can be performed by installing a program having the functions described with respect to the information processor into a computer and causing the computer to operate as the information processor.

The present apparatus can be implemented as hardware, software, or a combination of hardware and software. In the implementation with the combination of hardware and software, there is a typical example of the implementation with a computer system having a given program. In this instance, the given program is loaded into and executed by the computer system, by which the program causes the computer system to perform the processing according to the present invention. This program includes instruction groups that can be represented in an arbitrary language, code, or notation. The instruction groups enable the system to perform specific functions directly or after execution of one or both of the following: (1) conversion to any other language, code, or notation; and (2) copying to another medium. The present invention encompasses not only the program itself, but also a program product including the medium recording the program. The program for performing the functions of the present invention can be stored into an arbitrary computer-readable medium such as a flexible disk, MO, CD-ROM, DVD, hard disk drive, ROM, MRAM, or RAM. The program can be downloaded from another computer system connected via a communication line or copied from another medium for the storage to the computer-readable medium. In addition, the program can be compressed or divided into a plurality of sections and stored into a single or a plurality of recording mediums.

The following discusses an evaluation of the voice activity detection method according to one embodiment of the present invention as an embodiment. For an evaluation experiment, the CENSREC-1-C Japanese connected digit corpus for VAD from the Information Processing Society of Japan (IPSJ) SIG-SLP Noisy Automatic speech recognition Evaluation Working Group in Japan was used. The driving noises are added to the clean speech in 5 dB increments from 20 dB to −5 dB. The evaluation data used in this experiment includes 6986 sentences uttered by 52 male and 52 female speakers. The sampling frequency is 8 kHz. Assuming that the frame size and shift are 25 ms and 10 ms, respectively, the input speech was pre-emphasized using a filter $(1-0.97z^{-1})$ for each frame. After performing the Hamming windowing processing and 24-channel mel filter bank analysis, a 12-dimensional MFCC was extracted to obtain a delta cepstrum. An AURORA2J/CENSREC1 corpus which is provided by the same working group was used to train speech and non-speech GMMs for VAD. There are 1668 sentences uttered by 55 male and 55 female speakers. The number of mixtures is set to 32 for both speech and non-speech GMMs.

Table 1 shows five types of feature vector sets used for comparative evaluations described in the following embodiment. In the embodiment, GMMs were trained using these feature values. Feature vector sets (B1), (B2), and (B3) according to the related art have been prepared for comparison. More specifically, these feature vector sets include no long-term spectrum variation component. Feature vector sets (P1) and (P2) each include a long-term spectrum variation component in the voice activity detection method according to the present invention. Using the power of speech signal as a feature indicated by "power" is standard processing in this technical field.

TABLE 1

| Feature value | Remarks |
|---|---|
| (B1)<br>Baseline 1: MFCC 12-dimensional + power (13-dimensional in total) | Although not used alone so often in automatic speech recognition, MFCC is often used alone in VAD. |
| (B2)<br>Baseline 2: MFCC 12-dimensional + short-term Δ cepstrum 12-dimensional + power + Δ power (26-dimensional in total) | This combination is normally used in automatic speech recognition and often used in VAD. |
| (B3)<br>Baseline 3: Short-term Δ cepstrum 12-dimensional + power (13-dimensional in total) | Short-term delta cepstrum is used alone. The short-term delta cepstrum is hardly used alone, regardless of whether it is used in automatic speech recognition or in VAD. |
| (P1)<br>Proposed 1: Long-term Δ cepstrum 12-dimensional + power (13-dimensional in total) | The long-term delta cepstrum is used alone. |
| (P2)<br>Proposed 2: MFCC 12-dimensional + long-term Δ cepstrum 12-dimensional + power + Δ power (26-dimensional in total) | Combination of MFCC and delta cepstrum |

The feature vector sets for VAD were compared with each other by using a correct rate and an accuracy rate expressed by the following equations, respectively:

$$\text{Correct rate} = \frac{N_c}{N} \times 100 \quad \text{Eq. 10}$$

$$\text{Accuracy rate} = \frac{N_c - N_f}{N} \times 100 \quad \text{Eq. 11}$$

where N is the total number of utterances included in an evaluation set, Nc is the number of correct detections, and Nf is the number of incorrect detections. While the correct rate in the foregoing equation is a measure for evaluating what rate of voice activity detection is successfully achieved, the accuracy rate is a measure allowing for a case of incorrectly detecting noise as a user's speech (namely, a false alarm).

Figure 5:
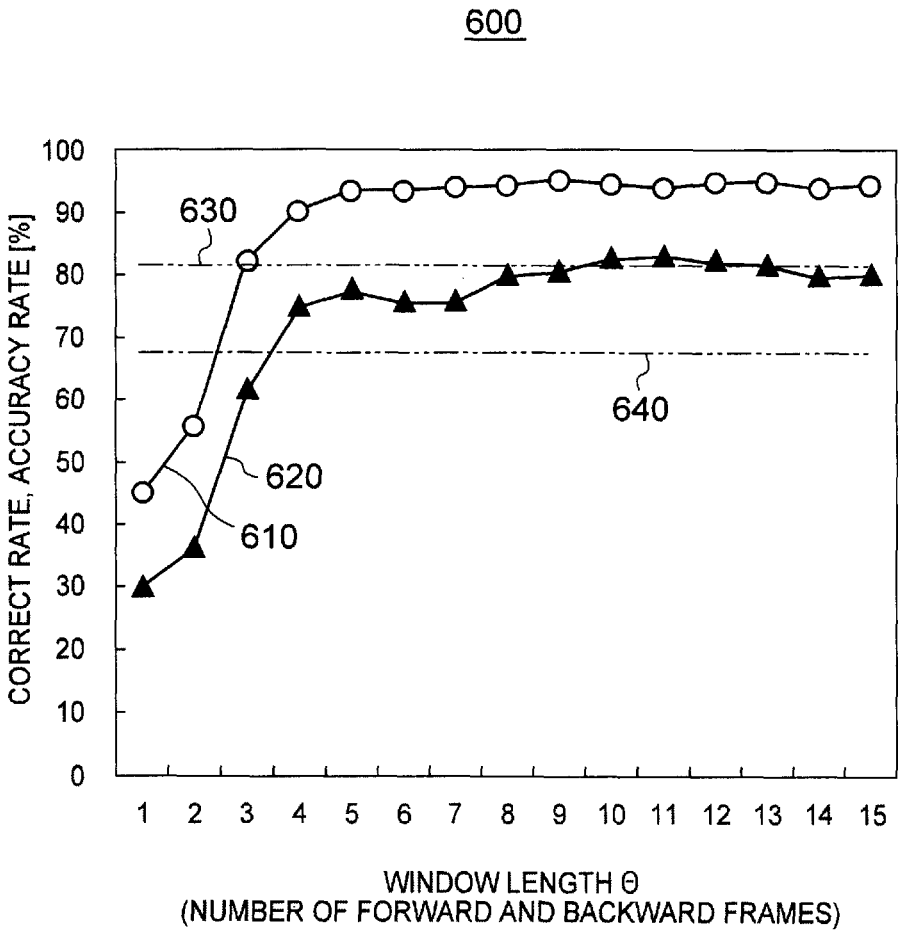
FIG. 5 is a diagram illustrating a relationship between the accuracy of the voice activity detection and a window length according to one embodiment of the present invention.

Referring to FIG. 5, a diagram is shown illustrating a relationship between the accuracy of voice activity detection and a window length according to one embodiment of the present invention. The abscissa axis of a performance transition based on the window length 600 represents the window length Θ as a forward and backward frame length, and the ordinate axis represents the percentages of the correct rate and the accuracy rate. As a feature vector, a delta cepstrum was used alone. When the window length Θ is varied in the range of 1 to 15, the performance of the voice activity detection rapidly decreases as the window length Θ becomes smaller in the range expressed by Θ≤3. On the other hand, in the range expressed by Θ≥4, the performance of the voice activity detection is improved in both of the correct rate and the accuracy rate. The window length Θ=4 has 80 ms in terms of time. The accuracy rate 620 is highest when Θ is set to 10 (time: 200 ms).

The result in the relationship between the window length and the performance in FIG. 5 shows that the long-term spectrum variation component includes important information in the voice activity detection. In FIG. 5, the correct rate of Baseline 1 (MFCC alone) 630 and the accuracy rate of Baseline 1 (MFCC alone) 640 are indicated by dashed lines for comparison purposes. More specifically, the correct rate of Baseline 1 (MFCC alone) 630 was 81.2% and the accuracy rate of Baseline 1 (MFCC alone) 640 was 66.9%. The voice activity detection method according to the present invention showed high performance in correct rate and accuracy by using the long-term spectrum variation component in the range expressed by the window length Θ≥4.

Figure 6:
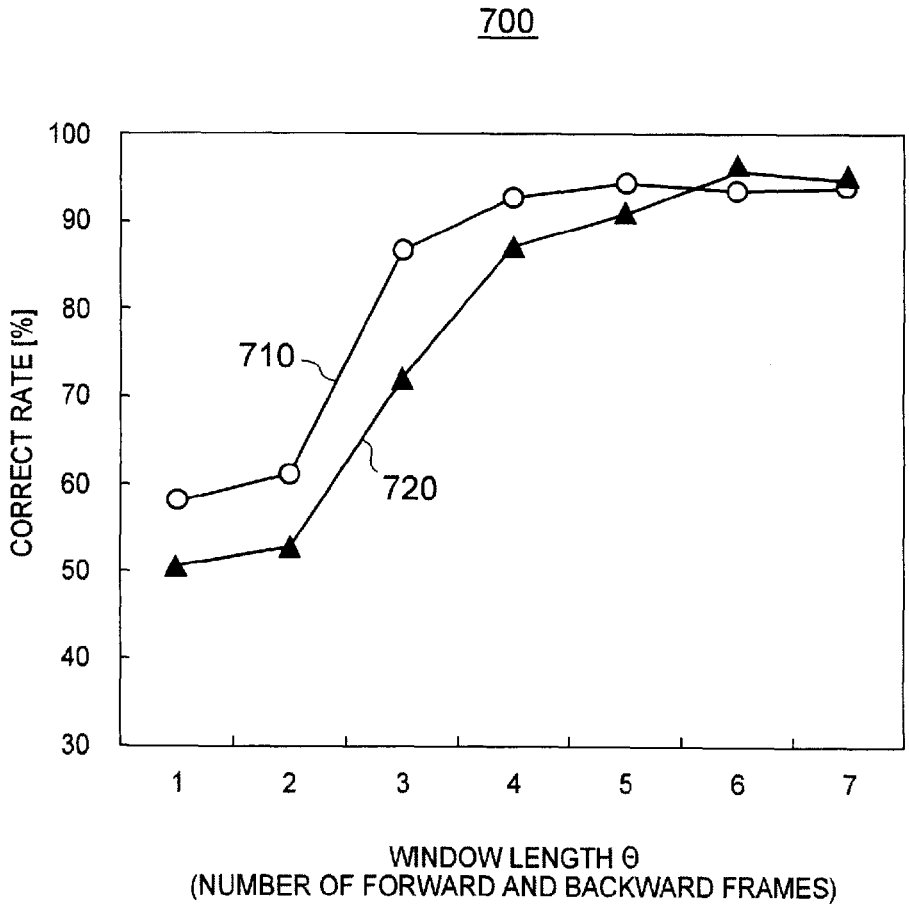
FIG. 6 is a diagram illustrating a relationship between the accuracy of the voice activity detection and a speech rate according to one embodiment of the present invention.

Referring to FIG. 6, a diagram is shown illustrating the relationship between the accuracy of voice activity detection and a speech rate according to one embodiment of the present invention. The abscissa axis of a performance transition based on the speech rate 700 is equivalent to the foregoing performance transition based on the window length 600 shown in FIG. 5, and the abscissa axis is the window length Θ as a forward and backward frame length. The ordinate axis represents the percentage of the correct rate. As a feature vector set, a delta cepstrum was used alone. By using an evaluation set of the average phoneme duration equal to or less than 80 ms and an evaluation set of the average phoneme duration equal to or more than 120 ms as inputs for voice activity detection, the window length Θ of the delta cepstrum was varied in the range of 1 to 7.

Both of the correct rate (%) in the evaluation set of the average phoneme duration equal to or less than 80 ms 710 and the correct rate (%) in the evaluation set of the average phoneme duration equal to or more than 120 ms 720 shown in FIG. 6 showed the dependence on the window length Θ. More specifically, the correct rates in both cases showed a tendency to increase in longer window lengths Θ. The long-term delta cepstrum approached the upper limit of performance at Θ=4 which shows 80 ms in terms of time in the evaluation set of the average phoneme duration equal to or less than 80 ms 710. Moreover, the long-term delta cepstrum reached the upper limit of performance at 0=6 which shows 120 ms in terms of time in the evaluation set of the average phoneme duration equal to or more than 120 ms 720. The proper delta window length for both test sets corresponded to their phoneme duration.

In the voice activity detection method according to the present invention, it is possible to achieve a performance close to the upper limit of the correct rate (%) in voice activity detection by using the long-term spectrum variation component calculated over the average phoneme duration. In the voice activity detection method according to the present invention, the window length for obtaining the delta cepstrum can be based on the average phoneme duration of the speech data or alternatively a typical value can be set in advance. If the long-term spectrum variation component is extracted from more than the average phoneme duration, it is possible to use the long-term spectrum variation component for the voice activity detection method according to the present invention.

Table 2 shows a comparison of the voice activity detection performance based on a difference in feature vectors according to one embodiment of the present invention. In VAD based on GMM, the operation time varies greatly depending on the number of dimensions of the feature vectors. Table 2 shows the results for each number of dimensions of the feature vector sets. More specifically, the feature vector sets (B1), (B3), and (P1) show the comparison in a 13-dimensional feature vector, while the feature vector sets (B2) and (P2) show the comparison in a 26-dimensional feature vector.

TABLE 2

| Feature value | Correct rate (%) | Accuracy rate (%) |
|---|---|---|
| (B1) Baseline 1: MFCC 12-dimensional + power (13-dimensional in total) | 81.2 | 66.9 |
| (B3) Baseline 3: Short-term Δ cepstrum + power (13-dimensional in total) | 82.3 | 61.2 |
| (P1) Proposed 1 : Long-term Δ cepstrum + power (13-dimensional in total) | 94.7 | 82.7 |
| (B2) Baseline 2: MFCC 12-dimensional + short-term Δ cepstrum 12-dimensional + power + Δ power (26-dimensional in total) | 92.2 | 80.0 |
| (P2) Proposed 2: MFCC 12-dimensional + long-term Δ cepstrum 12-dimensional + power + Δ power (26-dimensional in total) | 95.7 | 84.8 |

In Table 2, the short-term delta cepstrum was obtained from the window length Θ equal to 3 and the long-term delta cepstrum was obtained from the window length equal to 10. First, comparing the results of the 13-dimensional feature vector sets, the (P1) long-term delta cepstrum using the long-term spectrum variation remarkably improved in the voice activity detection performance in comparison with the (B1) MFCC and the (B3) short-term delta cepstrum. Although a delta cepstrum itself is not used alone in automatic speech recognition or VAD, the (P1) long-term delta cepstrum alone can remarkably contribute to the improvement in performance as apparent from the experimental result.

Subsequently, in the comparison of the 26-dimensional feature vector sets, the (B2) Baseline 2 includes a (short-term) temporal variation component and therefore the performance of the Baseline 2 is higher than the (B1) Baseline 1. It should be noted, however, that the (P1) long-term delta cepstrum achieved higher performance than the 26-dimensional (B2) Baseline 2, though the (P1) long-term delta cepstrum is a 13-dimensional feature vector. Moreover, the (P2) MFCC+ long-term delta cepstrum achieved the highest performance.

In the voice activity detection method according to the present invention, the correct rate and the accuracy rate in the voice activity determination can be improved by incorporating the long-term spectrum variation component into the feature vector in both cases where the feature vector is 13-dimensional and is 26-dimensional.

Table 3 shows the effect of noise intensity on the accuracy of the voice activity detection according to one embodiment of the present invention.

The feature vector sets in this experiment are the same as in Table 2, and the correct rate (%) and the accuracy rate (%) were obtained for each of the high SNR condition and the low SNR condition. The "high SNR" column shows average values of the correct rate (%) and the accuracy rate (%) at clean (no noise), 20 dB, 15 dB, and 10 dB SNR level. The "low SNR" column shows average values of the correct rate (%) and the accuracy rate (%) at 5 dB, 0 dB, and −5 dB SNR level.

TABLE 3

| | Correct rate (%) | | Accuracy rate (%) | |
|---|---|---|---|---|
| Feature value | High SNR | Low SNR | High SNR | Low SNR |
| (B1) Baseline 1: MFCC 12-dimensional + power(13-dimensional in total) | 94.6 | 63.2 | 90.5 | 35.5 |
| (B3) Baseline 3: Short-term Δ cepstrum + power (13-dimensional in total) | 93.9 | 66.8 | 86.5 | 27.5 |
| (P1) Proposed 1 : Long-term Δ cepstrum + power (13-dimensional in total) | 99.7 | 88.1 | 97.8 | 62.4 |
| (B2) Baseline 2: MFCC 12-dimensional + short-term Δ cepstrum 12-dimensional + power + Δ power (26-dimensional in total) | 99.1 | 82.9 | 96.3 | 58.3 |
| (P2) Proposed 2: MFCC 12-dimensional + long-term Δ cepstrum 12-dimensional + power + Δ power (26-dimensional in total) | 99.7 | 90.4 | 97.8 | 67.5 |

Apparent from the result in Table 3, higher performance was observed in voice activity detection using the long-term spectrum variation component (long-term delta cepstrum), namely in voice activity detection using the feature vector sets (P1) and (P2) than in voice activity detection using the feature vector sets (B1), (B2), and (B3) according to related art. Particularly, under the "low SNR" condition, the voice activity detection using the feature vector sets (P1) and (P2) according to the present invention remarkably improved in performance. More specifically, the voice activity detection using the long-term spectrum variation component according to the present invention has an advantageous effect that accurate voice activity detection is achieved and false alarms are effectively reduced under the low SNR condition.

Table 4 shows an effect of the harmonic structure on the accuracy of voice activity detection according to one embodiment of the present invention. In this embodiment, the correct rate and the accuracy rate of voice activity detection using a feature vector set (P3), where the harmonic structure according to the present invention is used together, were obtained in addition to the feature vector set (B2) according to related art and the feature vector set (P2) according to the present invention. The experimental conditions are the same as in the verification experiment of the long-term delta cepstrum in Table 2 and Table 3. The correct rate (%) and the accuracy rate (%) were obtained under the high SNR condition and under the low SNR condition.

In the feature vector set (P3) shown in Table 4, a harmonic structure feature vector (fLPE cepstrum) is used instead of MFCC and used together with the long-term delta cepstrum. As shown in the experimental result, the voice activity detection further improved in performance by using the fLPE cepstrum, and particularly the accuracy rate under the low SNR condition remarkably improved. Although the accuracy rate under the high SNR condition shows a slight adverse effect, the adverse effect will not significantly reduce the performance of the entire system.

TABLE 4

| | Correct rate (%) | | Accuracy rate (%) | |
|---|---|---|---|---|
| Feature value | High SNR | Low SNR | High SNR | Low SNR |
| (B2) Baseline 2: MFCC 12-dimensional + short-term Δ cepstrum 12-dimensional + power + Δ power (26-dimensional in total) | 99.1 | 82.9 | 96.3 | 58.3 |
| (P2) Proposed 2: MFCC 12-dimensional + long-term Δ cepstrum 12-dimensional + power + Δ power (26-dimensional in total) | 99.7 | 90.4 | 97.8 | 67.5 |
| (P3) Proposed 3: fLPE cepstrum + long-term Δ cepstrum 12-dimensional + power + Δ power (26-dimensionalin total) | 99.8 | 91.7 | 97.0 | 75.7 |

While the present invention has been described hereinabove in conjunction with the preferred embodiments, it is to be understood that the technical scope of the present invention is not limited to the above described embodiments. It is apparent to those skilled in the art that various modifications or improvements can be made to the above embodiments. It is apparent from the appended claims that the technical scope of the present invention can include the embodiments in which such modifications or improvements have been made. For example, it is possible to similarly cope with a speech processing system, a automatic speech recognition system, or a speech output system by using the voice activity detection method according to the present invention.

We claim:

1. A speech processing system for processing a speech by a computer, the system comprising:

(1) means for dividing an input speech signal into frames;

(2) means for converting said input speech signal to a logarithmic power spectrum for each frame;

(3) long-term spectrum variation component extraction means comprising:

transform means for transforming said logarithmic power spectrum to mel cepstrum coefficients; and extraction means for extracting a long-term spectrum variation component from a sequence of said mel cepstrum coefficients by linear regression calculation using a longer delta window than an average phoneme duration of an utterance in said speech signal, said long-term spectrum variation component comprising a first feature vector for the frame;

(4) harmonic structure feature extraction means comprising:

discrete cosine transform means for transforming said logarithmic power spectrum to cepstrum coefficients by a discrete cosine transform;

clipping means for cutting off upper and lower cepstrum components from said cepstrum coefficients;

transform means for inverse discrete cosine transforming said cepstrum coefficients from which said upper and lower cepstrum components have been cut;

conversion means for converting an output of said inverse discrete cosine transform back to a power spectrum;

processing means for mel filter bank processing said power spectrum; and harmonic structure transform means for transforming a mel filter bank processed output to a harmonic structure feature by said discrete cosine transform, to generate a second feature vector for each frame, the second feature vector comprising the harmonic structure feature; and (5) means for determining a voiced segment by concatenating the first feature vector from said long-term spectrum variation component means and the second feature vector from said harmonic structure feature means and comparing the concatenated feature vectors to a statistical model.

2. The speech processing system according to claim 1, further comprising:

means for normalizing said power spectrum.

3. The speech processing system according to claim 1, wherein said means for cutting off upper and lower cepstrum components further comprises extracting components corresponding to said harmonic structure in a possible range as a human speech.

4. A speech processing method for processing a speech by a computer device, the method comprising the steps of:

dividing an input speech signal into frames, wherein said input speech signal is received from a voice activity detection apparatus;

converting said input speech signal to a logarithmic power spectrum;

performing long-term spectrum variation component extraction to generate a first feature vector by steps of:

transforming said logarithmic power spectrum to mel cepstrum coefficients; and extracting a long-term spectrum variation component from a sequence of said mel cepstrum coefficients by linear regression calculation using a longer delta window than an average phoneme duration of an utterance in said input speech signal to generate a first feature vector;

performing harmonic structure feature extraction to generate a second feature vector by steps of:

transforming said logarithmic power spectrum to cepstrum coefficients by a discrete cosine transform;

cutting off upper and lower cepstrum components from said cepstrum coefficients;

inverse discrete cosine transforming said cepstrum coefficients from which said upper and lower cepstrum components have been cut;

converting an output of said inverse discrete cosine transform back to a power spectrum;

mel filter bank processing said power spectrum to produce mel filter bank processed output; and transforming said mel filter bank processed output to a second feature vector comprising a harmonic structure feature by said discrete cosine transform, and determining a voiced segment by using said long-term spectrum variation component first feature vector concatenated with said harmonic structure feature second feature vector and comparing the concatenated feature vectors to a statistical model, wherein at least one of the steps is carried out using the computer device.

5. The speech processing method according to claim 4, further comprising the step of:

normalizing said power spectrum.

6. The speech processing method according to claim 4, wherein the step of cutting off upper and lower cepstrum components further comprises extracting components corresponding to said harmonic structure in a possible range as a human speech.

7. A speech processing program product tangibly embodying computer readable non-transitory instructions which, when implemented, causes a computer device to perform the steps of:

dividing an input speech signal into frames, wherein said input speech signal is received from a voice activity detection apparatus;

converting said input speech signal to a logarithmic power spectrum;

performing long-term spectrum variation component extraction to generate a first feature vector by steps of:

transforming said logarithmic power spectrum to mel cepstrum coefficients; and extracting a long-term spectrum variation component from a sequence of said mel cepstrum coefficients by linear regression calculation using a longer delta window than an average phoneme duration of an utterance in said input speech signal to generate a first feature vector;

performing harmonic structure feature extraction to generate a second feature vector by steps of:

transforming said logarithmic power spectrum to cepstrum coefficients by a discrete cosine transform;

cutting off upper and lower cepstrum components from said cepstrum coefficients;

inverse discrete cosine transforming said cepstrum coefficients from which said upper and lower cepstrum components have been cut;

converting an output of said inverse discrete cosine transform back to a power spectrum;

mel filter bank processing said power spectrum to produce mel filter bank processed output; and transforming said mel filter bank processed output to a second feature vector comprising a harmonic structure feature by said discrete cosine transform, and determining a voiced segment by using said long-term spectrum variation component first feature vector concatenated with said harmonic structure feature second feature vector and comparing the concatenated feature vectors to a statistical model.

8. A speech output system for outputting a speech entered from a microphone by a computer, the system comprising:

(1) means for converting said speech entered from said microphone into a digital speech signal by ND conversion;

(2) means for dividing said digital speech signal into frames;

(3) means for converting said digital speech signal divided into frames to a logarithmic power spectrum;

(4) long-term spectrum variation component extraction means comprising:

transform means for transforming said logarithmic power spectrum to mel cepstrum coefficients; and extraction means for extracting a long-term spectrum variation component from a sequence of said mel cepstrum coefficients by linear regression calculation using a longer delta window than an average phoneme duration of an utterance in said speech signal, said long-term spectrum variation component comprising a first feature vector for the frame;

(5) harmonic structure feature extraction means comprising:

discrete cosine transform means for transforming said logarithmic power spectrum to cepstrum coefficients by a discrete cosine transform;

clipping means for cutting off upper and lower cepstrum components from said cepstrum coefficients;

transform means for inverse discrete cosine transforming said cepstrum coefficients from which said upper and lower cepstrum components have been cut;

conversion means for converting an output of said inverse discrete cosine transform back to a power spectrum;

processing means for mel filter bank processing said power spectrum; and harmonic structure transform means for transforming a mel filter bank processed output to a harmonic structure feature by said discrete cosine transform, to generate a second feature vector for each frame, the second feature vector comprising the harmonic structure feature;

(6) means for determining a voiced segment by concatenating the first feature vector from said long-term spectrum variation component means and the second feature vector from said harmonic structure feature means and comparing the concatenated feature vectors to a statistical model;

(7) means for discriminating speech and non-speech segments in said digital speech signal by using said voiced segment information; and (8) means for converting said discriminated speech included in said digital speech signal into said speech as an analog speech signal by D/A conversion.

* * * * *